US006263644B1

(12) United States Patent
Ghini et al.

(10) Patent No.: US 6,263,644 B1
(45) Date of Patent: Jul. 24, 2001

(54) METHOD AND MACHINE FOR WRAPPING A PRODUCT IN A SHEET OF HEAT-SEAL WRAPPING MATERIAL

(75) Inventors: Marco Ghini, S. Lazzaro di Savena; Mario Spatafora, Bologna, both of (IT)

(73) Assignee: G. D Societa' per Azioni, Bologna (IT)

( * ) Notice: Subject to any disclaimer, the term of this patent is extended or adjusted under 35 U.S.C. 154(b) by 0 days.

(21) Appl. No.: 09/345,131

(22) Filed: Jul. 6, 1999

(30) Foreign Application Priority Data

Jul. 8, 1998 (IT) ..... B098A0415

(51) Int. Cl.[7] ..... B65B 51/10
(52) U.S. Cl. ..... 53/463; 53/466; 53/234
(58) Field of Search ..... 53/477, 463, 373.7, 53/375.9, 228, 466, 234; 493/189, 208; 219/604, 612, 614

(56) References Cited

U.S. PATENT DOCUMENTS

| | | | | |
|---|---|---|---|---|
| 3,035,379 | | 5/1962 | Cloots et al. . | |
| 3,348,474 | | 10/1967 | Virta et al. . | |
| 3,431,398 | | 3/1969 | Wahle et al. . | |
| 3,864,186 | * | 2/1975 | Balla | 219/604 |
| 5,123,226 | * | 6/1992 | Near | 53/375.9 |
| 5,477,661 | * | 12/1995 | Draghetti et al. | 53/477 |
| 5,613,344 | * | 3/1997 | Osti et al. | 53/375.9 |
| 5,811,185 | * | 9/1998 | Schreck et al. | 428/516 |
| 5,900,310 | * | 5/1999 | Murschall et al. | 428/516 |
| 5,996,318 | * | 12/1999 | Draghetti | 53/466 |
| 6,000,199 | * | 12/1999 | Boldrini | 53/466 |
| 8,839,253 | * | 11/1998 | Draghetti | 53/234 |

FOREIGN PATENT DOCUMENTS

| | | |
|---|---|---|
| 3718702 | 12/1988 | (DE) . |
| 0079760 | 5/1983 | (EP) . |
| 2277729 | 2/1976 | (FR) . |
| 2045678 | 11/1980 | (GB) . |

OTHER PUBLICATIONS

English Translation of Abstract of DE 3718702.
English Translation of Abstract of FR 2277729.

* cited by examiner

*Primary Examiner*—Ira S. Lazarus
*Assistant Examiner*—Louis K. Huynh
(74) *Attorney, Agent, or Firm*—Ladas and Parry

(57) ABSTRACT

A method and machine for wrapping a product in a sheet of heat-seal wrapping material, whereby the sheet of wrapping material is folded onto the product so that one portion of the sheet of wrapping material is at least partly superimposed on at least another portion of the sheet of wrapping material; a sealing surface of a sealing head is brought into contact with the superimposed portions at a given lead-in temperature, and is maintained contacting the superimposed portions for a given time interval during which the temperature of the sealing surface is gradually increased to a given working value, and is once more restored to the lead-in value once the sheet of wrapping material is released.

12 Claims, 3 Drawing Sheets

METHOD AND MACHINE FOR WRAPPING A PRODUCT IN A SHEET OF HEAT-SEAL WRAPPING MATERIAL

The present invention relates to a method of wrapping a product in a sheet of heat-seal wrapping material.

The present invention may be used to particular advantage on machines for cellophaning packets of cigarettes, to which the following description refers purely by way of example.

BACKGROUND OF THE INVENTION

On known machines for cellophaning packets of cigarettes, a sheet of heat-seal wrapping material is folded against one wall of the product, and at least two portions of the sheet of wrapping material superimposed one on top of the other; and a sealing surface of a sealing head is then brought into and maintained for a given length of time in contact with the superimposed portions to seal the portions together and stabilize the sheet of wrapping material in the folded configuration.

On known cellophaning machines, the sealing surface of the sealing head is maintained constantly at an operating temperature which gets closer to the melting temperature of the heat-seal material in direct proportion to the increase in the operating speed of the machine.

When the sealing surface is brought rapidly into contact with the superimposed portions of the sheet of wrapping material and the temperature of the sealing surface is close to the melting temperature of the heat-seal material, the portions of the sheet of wrapping material contacting or close to the sealing surface tend to crease and/or become undulated, thus seriously impairing the appearance of the wrapping. This problem is particularly noticeable on modern cellophaning machines operating at very high speeds of over 500 packets a minute.

SUMMARY OF THE INVENTION

It is an object of the present invention to provide a method of wrapping a product in a sheet of heat-seal wrapping material, designed to eliminate the aforementioned drawback, and which at the same time is both straightforward and cheap to implement.

According to the present invention, there is provided a method of wrapping a product in a sheet of heat-seal wrapping material, the method comprising the steps of folding said sheet of wrapping material about said product and superimposing at least two portions of the sheet of wrapping material one on top of the other against a wall of said product; establishing contact between the superimposed portions and a sealing surface of a sealing head; maintaining the sealing surface in contact with said superimposed portions for a given time interval; and cutting off contact between the sealing surface and said superimposed portions; characterized in that the temperature of the sealing surface is set to a lead-in first value as the sealing surface first contacts said superimposed portions, and is increased to a working second value during said given time interval.

The present invention also relates to a machine for wrapping a product in a sheet of heat-seal wrapping material.

According to the present invention, there is provided a machine for wrapping a product in a sheet of heat-seal wrapping material, the machine comprising folding means for folding said sheet of wrapping material about said product and superimposing at least two portions of the sheet of wrapping material one on top of the other against a wall of said product; a sealing head having a sealing surface; actuating means for establishing contact between the superimposed portions and the sealing surface of said sealing head; and control means for controlling the temperature of said sealing surface; characterized in that said control means provide for setting the temperature of the sealing surface to a lead-in first value upon the sealing surface first contacting said superimposed portions, and for increasing the temperature of the sealing surface to a working second value during a time interval in which the sealing surface contacts said superimposed portions.

BRIEF DESCRIPTION OF THE DRAWINGS

A non-limiting embodiment of the present invention will be described by way of example with reference to the accompanying drawings, in which.

DETAILED DESCRIPTION OF THE INVENTION

Figure 1:
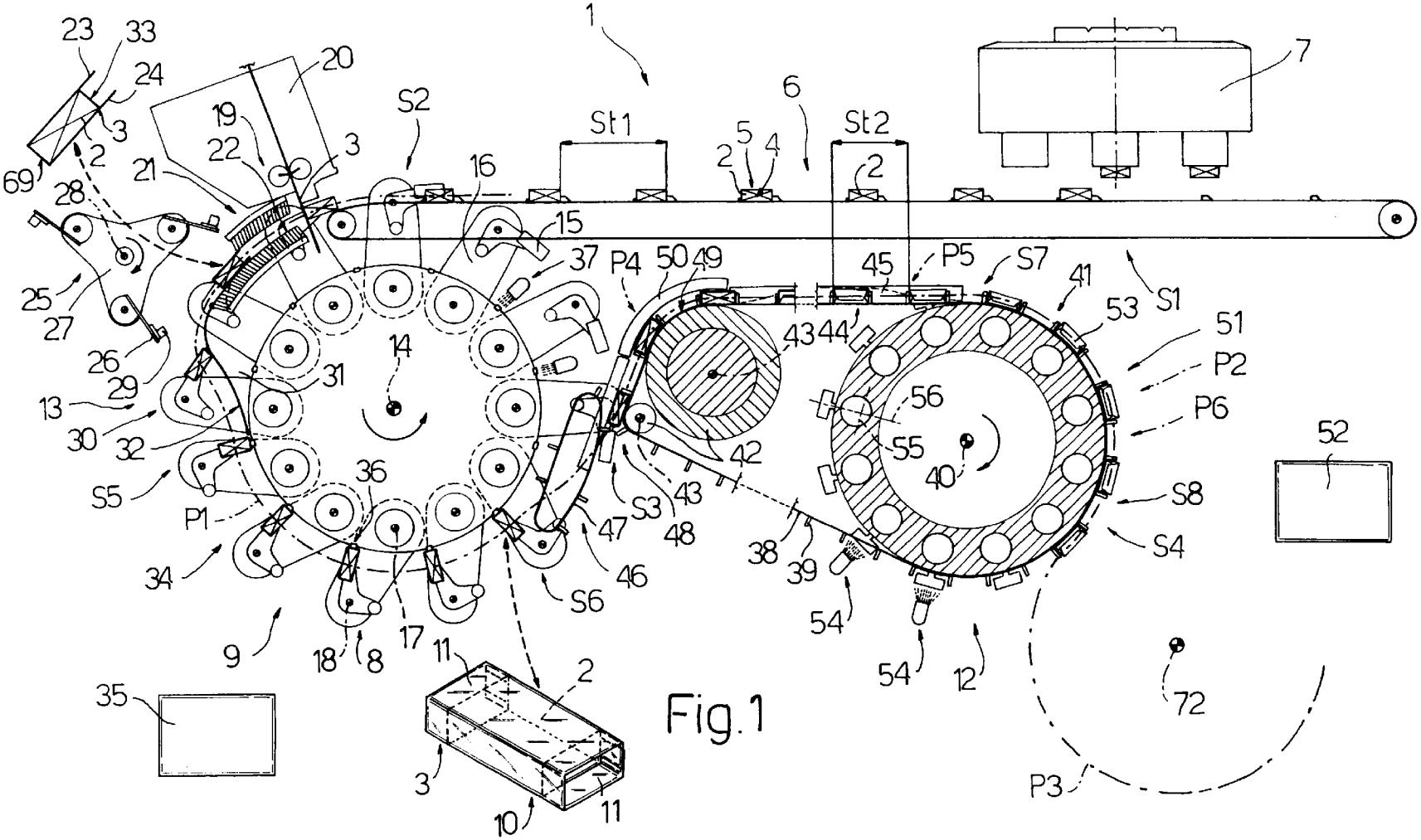
FIG. 1 shows a schematic, partially sectioned side view of a preferred embodiment of the machine according to the present invention.

Number 1 in FIG. 1 indicates a continuous cellophaning machine for overwrapping packets 2 of cigarettes in respective sheets 3 of heat-seal wrapping material, in particular polypropylene having a melting temperature ranging between 90° C. and 140° C.

Each packet 2 is substantially in the form of an elongated parallelepipedon, and comprises two opposite longitudinal end bases 4, and a lateral surface 5 perpendicular to bases 4.

Packets 2 are fed by a known supply device 7 to an input conveyor 6 of machine 1 at an input station S1.

Conveyor 6 receives and feeds packets 2 from input station S1 to a transfer station S2 with a spacing St1 (actually equal to approximately 180 mm), and engages lateral surface 5 of each packet 2, leaving bases 4 free.

At station S2, each packet 2 is transferred to a respective conveying head 8, which engages bases 4 of respective packet 2 and is fitted to a wrapping conveyor 9 for feeding packets 2 successively along a wrapping path P1.

Along path P1, each packet 2 is paired with a respective sheet 3 of wrapping material, which is subsequently folded to form about packet 2 a tubular wrapping 10, which is stabilized by sealing, has two opposite open ends 11, and at least partially encloses respective conveying head 8.

The spacing and the traveling speed of packets 2 along path P1 substantially equal St1 and V1 respectively. However, due to certain movements performed, in use, by head 8 with respect to conveyor 9 and described in detail later on, the spacing and traveling speed of packets 2 along path P1 vary temporarily about values St1 and V1 respectively.

Path P1 terminates at a transfer station S3 where each packet 2 is transferred to a wrapping conveyor 12 which feeds packets 2, enclosed in respective tubular wrappings 10, successively along a wrapping path P2 and with a spacing St2 smaller than spacing St1 and actually equal to 120 mm.

Packets 2 are therefore fed along conveyor 6 and, substantially, along path P1 with a spacing substantially equal to St1, and are fed along path P2 with a spacing St2 smaller than St1. To maintain a constant flow of packets 2 (i.e. the number of packets 2 processed per unit time) along machine 1, the traveling speed V1 of packets 2 along conveyor 6 and path P1 must be greater than the traveling speed V2 of packets 2 along path P2. In particular, to maintain a constant flow, the ratio between spacings St1 and St2, which is actually 1.5, must equal the ratio between speeds V1 and V2.

Along path P2, the open ends 11 of each tubular wrapping 10 are closed and stabilized by sealing to complete the overwrapping of packets 2 in respective sheets 3; and path P2 terminates at a transfer station S4 where the overwrapped packets 2 are transferred to a known output section (not shown) which feeds packets 2 along a drying path P3 and then to a known output (not shown) of machine 1.

Conveyor 9 comprises a powered wheel 13, which is mounted to rotate continuously about a fixed central axis 14 perpendicular to the FIG. 1 plane, and which supports a number of conveyor heads 8 equally spaced about axis 14.

Each conveyor head 8 comprises a pair of opposed gripping pads 15, each of which engages a respective base 4 of a packet 2 and in turn comprises a respective retaining member (not shown) for retaining sheet 3 of wrapping material in a given fixed position with respect to pad 15. Each pair of pads 15 is connected to wheel 13 by a respective arm 16 which is oscillated, with respect to wheel 13, about a respective axis 17 parallel to axis 14 by a known cam control device (not shown); and each pair of pads 15 is oscillated, with respect to respective arm 16, about a respective axis 18 parallel to axis 14 by said known cam control device (not shown), which also moves each pad 15 along axis 18 to and from a work position contacting a respective base 4 of respective packet 2.

Machine 1 comprises a known supply station 19 for supplying sheets 3 of wrapping material, and which is located along an initial portion of path P1 and in turn comprises a known supply unit 20 for feeding a sheet 3 of wrapping material in a direction perpendicular to and through path P1.

Machine 1 comprises a passive wrapping fixture 21 (i.e. a fixture having no moving parts) located in a fixed position along path P1, immediately downstream from supply station 19, and which is defined by a folding channel 22 having folding brushes and for folding a sheet 3 of wrapping material into a U about a respective packet 2 fed by a respective head 8 along path P1. Once folded into a U about respective packet 2, each sheet 3 of wrapping material has two wings 23 and 24 projecting transversely and rearwards from packet 2.

Machine 1 comprises an active wrapping fixture 25 (i.e. a fixture having at least one moving part) located along path P1, immediately downstream from folding channel 22, to fold wing 23 through 90° onto packet 2. Fixture 25 comprises a number of wrapping tools 26 fitted to a wheel 27 powered to rotate continuously about a fixed axis 28 parallel to axis 14.

Each wrapping tool 26 comprises a generating device 29 for generating an electrostatic field, which acts on wing 23 to polarize and enable wing 23, once folded, to adhere at least temporarily to packet 2.

Machine 1 also comprises a passive wrapping fixture 30 located in a fixed position along path P1, downstream from folding channel 22, to fold wing 24 of sheet 3 of wrapping material through 90° onto respective packet 2 and partly onto the previously folded wing 23 to define respective tubular wrapping 10.

Wrapping fixture 30 comprises a body 31 having a surface 32, which defines a folding surface along which packet 2 is substantially rolled, by rotating respective head 8 about respective axis 18, to fold wing 24 through 9°.

Figure 7:
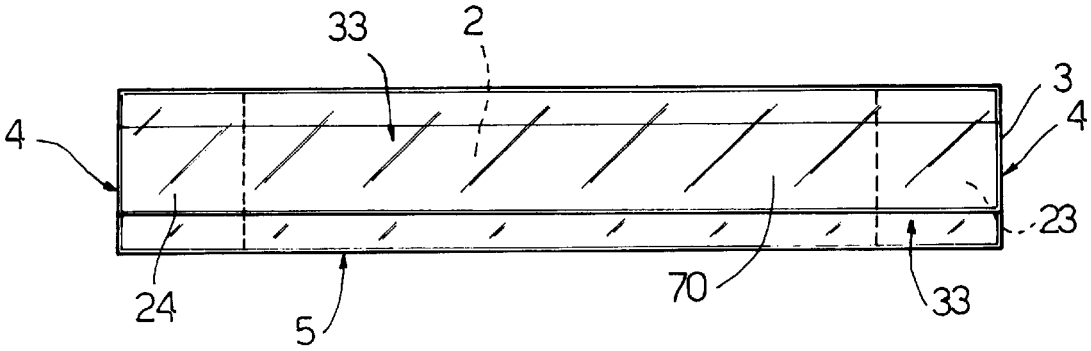
FIG. 7 shows a further view of the product processed on the FIG. 1 machine.

FIG. 7 shows a wall 33 of lateral surface 5 of a packet 2, onto which wings 23 and 24 of a respective sheet 3 of wrapping material have been folded and overlapped.

Wrapping wheel 13 comprises a sealing unit 34 in turn comprising a control device 35 (shown schematically in FIG. 6), a number of sealing heads 36 controlled by device 35, and a cooling device 37 also controlled by device 35.

Each head 36 is fitted in a fixed position to wheel 13, is associated with a respective conveyor head 8, and provides for stabilizing a respective tubular wrapping 10 by on-edge sealing the superimposed portions of wings 23 and 24 folded onto respective packet 2. More specifically, packet 2 is engaged by head 36 at an input station S5 located at the end of surface 32, and is released by head 36 at an output station S6 upstream from station S3.

Wrapping conveyor 12 comprises a conveyor belt 38 moving continuously along path P2 and having projections 39 spaced with spacing St2 to engage and feed forward packets 2. Path P2 comprises a straight initial portion P4; a downstream straight portion P5 connected to portion P4 by a curved portion; and a circular end portion P6 extending about a fixed axis 40 parallel to axis 13.

Along circular portion P6, belt 38 extends about a wheel 41 powered to rotate continuously about axis 40; and, at the opposite ends of portion P4, belt 38 extends about a pair of idle transmission rollers 42 rotating about respective axes 43 parallel to axis 40.

Machine 1 comprises a folding device 44 located along straight portion P5 of path P2 to fold the open ends 11 of each tubular wrapping 10 onto respective packet 2 as packet 2 travels along portion P5 of path P2. Folding device 44 comprises a known first movable folding element (not shown) for making a first fold of open ends 11; and two known fixed helical folding elements 45 (only one shown in FIG. 1) located on either side of path P2 to engage respective open ends 11 of each tubular wrapping 10.

Figure 5:
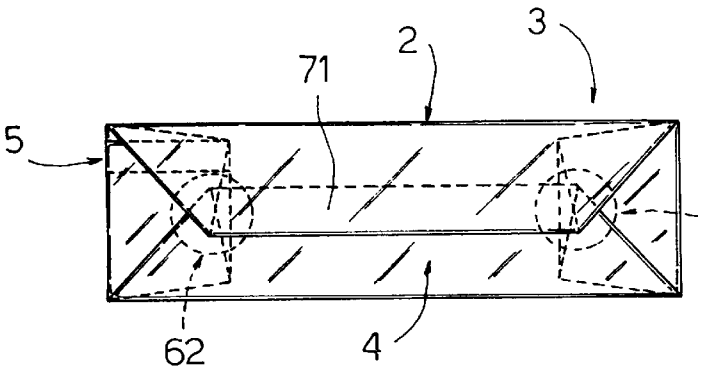
FIG. 5 shows a larger-scale view of the product processed on the FIG. 1 machine.

FIG. 5 shows a base of a packet 2, against which the portions defining one end 11 of a respective sheet 3 of wrapping material have been folded and overlapped.

Machine 1 also comprises a transfer unit 46 located between conveyors 9 and 12 at transfer station S3, and which in turn comprises a belt 47 looped about a pair of end pulleys (not shown) to guide packets 2 to an input 48 of a channel 49 extending along portion P4 and defined on one side by a fixed surface 50 and on the other side by conveyor belt 38.

Wheel 41 comprises a sealing unit 51 in turn comprising a control device 52 (shown schematically in FIG. 2), a number of pairs of sealing heads 53 (only a first head in each pair shown in FIG. 1) controlled by device 52, and a cooling device 54 also controlled by device 52. Each pair of heads 53 is fitted to wheel 41 and provides for stabilizing, by sealing, ends 11 of each tubular wrapping 10 folded by folding device 44.

Heads 53 in each pair are fed forward in time with packets 2, and are positioned facing each other to simultaneously engage respective opposite ends 11 of a respective tubular wrapping 10, which is engaged by heads 53 at an input station S7 located at the end of folding device 44, and is released by heads 53 at an output station S8 upstream from station S4.

Each sealing head 53 is fitted to wheel 41 to oscillate, with respect to wheel 41, about an axis 55 parallel to path P2, and to simultaneously oscillate about an axis 56, which oscillates about axis 55 together with sealing head 53 while remaining perpendicular to axis 55. The oscillation about axis 55 substantially moves respective sealing head 53 in a direction perpendicular to path P2.

Figure 2:
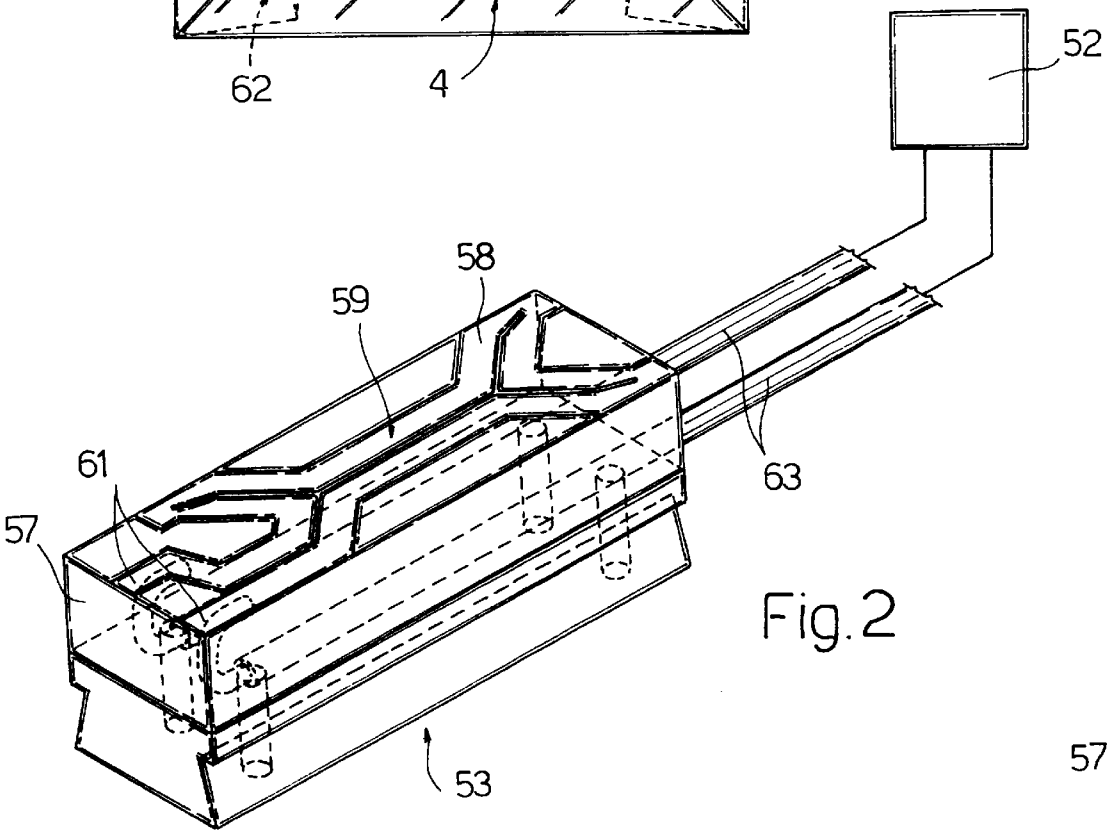
FIG. 2 shows a larger-scale view in perspective of a detail of the FIG. 1 machine.

As shown more clearly in FIG. 2, each sealing head 53 comprises a supporting pad 57 made of thermally insulating material (in particular, silicone rubber); and a plate 58 fitted to pad 57 and made of electrically and thermally conductive material (in particular, metal). Each plate 58 defines a sealing surface 59, and comprises a strip extending along a work path 60 having two ends 61. Control device 52 comprises a known electric generator (not shown) connected electrically to the two ends 61 to circulate alternating or direct electric current of adjustable intensity along plate 58 and work path 60.

In a preferred embodiment, control device 52 comprises a known measuring unit (not shown) for determining the total electric resistance of plate 58 by measuring the voltage and current values between ends 61, and for determining, according to said resistance, the temperature of plate 58 and therefore of sealing surface 59.

In an alternative embodiment not shown, control device 52 comprises a number of temperature sensors (in particular, thermocouples), each associated with a respective sealing head 53 to determine the temperature of sealing surface 59 of respective plate 58.

Control device 52 controls the known electric generator (not shown) to regulate the intensity of the electric current along each plate 58 according to the temperature of sealing surface 59, and to keep the temperature of sealing surface 59 equal to a given value at all times.

Figure 4:
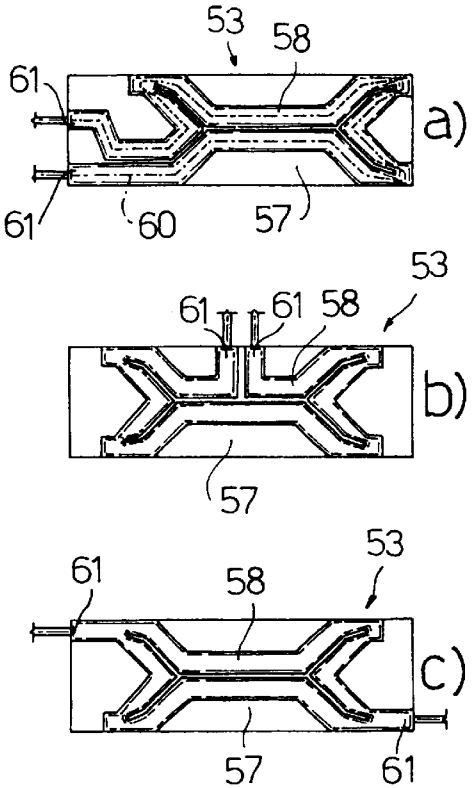
FIGS. 4(*a–e*) shows a plan view and two variations of the FIG. 2 detail.

As shown in the various embodiments in FIG. 4 (and by comparing FIGS. 4 and 5), work path 60 is so formed as to reproduce the layout of the superimposed portions of sheet 3 of wrapping material and so concentrate the heat produced by plate 58 solely on the overlapping portions of sheet 3.

In an alternative embodiment, the thickness of plate 58 varies along work path 60. In particular, the area of each cross section of plate 58 varies in inverse proportion to the total thickness of the heat-seal material with which the section is brought into contact. That is, at the maximum total thickness portions of the heat-seal material (indicated 62 by way of example in FIG. 5), the corresponding cross sections of plate 58 are smaller in area, so that the electric resistance of plate 58 at said sections is greater and, by virtue of the Joule effect, plate 58 produces more heat.

In a preferred embodiment, the known electric generator (not shown) generates a succession of electric current pulses of adjustable intensity and frequency.

Figure 3:
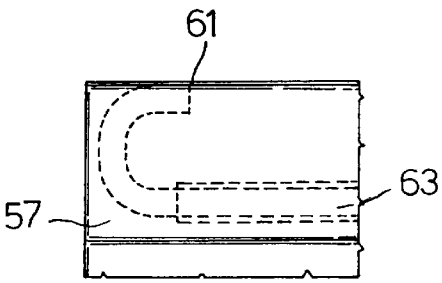
FIG. 3 shows a schematic side view of a portion of the FIG. 2 detail.

As shown in FIGS. 2 and 3, the conductors 63 connecting ends 61 to the known electric generator (not shown) are embedded in pad 57.

Figure 6:
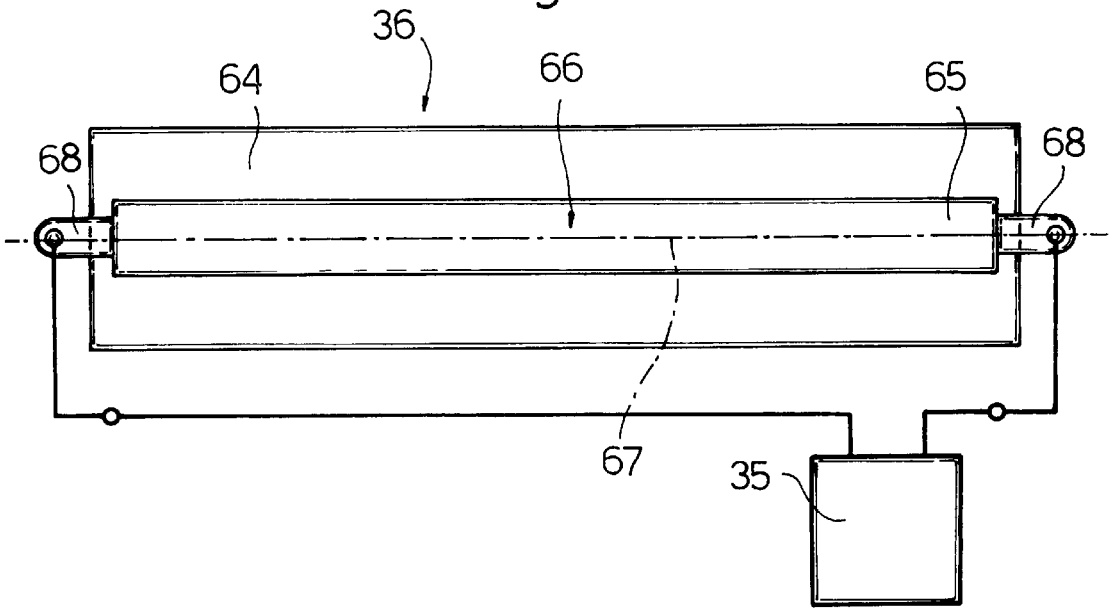
FIG. 6 shows a larger-scale plan view of a further detail of the FIG. 1 machine.

Sealing heads 36 are identical to sealing heads 53. As shown in FIG. 6, each sealing head 36 therefore comprises a supporting pad 64 made of thermally insulating material (in particular, silicone rubber); and a plate 65, which is fitted to pad 64, is made of electrically and thermally conducting material (in particular, metal), defines a sealing surface 66, and comprises a strip extending along a work path 67 having two ends 68. Control device 35 comprises a known electric generator (not shown) connected electrically to the two ends 68 to circulate alternating or direct electric current of adjustable intensity along plate 65 and work path 67.

As shown by comparing FIGS. 6 and 7, work path 67 is also formed to reproduce the layout of the superimposed portions of sheet 3 of wrapping material and so concentrate the heat produced by plate 65 solely on the overlapping portions of sheet 3.

Cooling devices 37 and 54 are identical, are located in fixed positions with respect to respective wheels 13 and 41, provide for cooling respective sealing surfaces 59 and 66, and are defined by respective ventilators, each for blowing air onto respective sealing surface 59, 66.

Operation of cellophaning machine 1 will now be described with reference to one packet 2, and as of the instant in which packet 2 is fed by supply device 7 onto conveyor 6 at station S1 and with spacing St1.

Conveyor 6 feeds packet 2 continuously to station S2 where packet 2 is transferred to a respective head 8 which, rotating about axes 14, 17 and 18, feeds packet 2 along path P1 and through supply station 19 where supply unit 20 has already positioned a respective sheet 3 of wrapping material perpendicular to path P1, so that, as packet 2 is fed along path P1, a wall 69—parallel to and opposite wall 33 and at the front (in the traveling direction)—of lateral surface 5 of packet 2 engages a corresponding portion of sheet 3.

As head 8 continues along path P1, packet 2 is fed into folding channel 22, which folds sheet 3 into a U about packet 2 and partly about respective pads 15, so that, at the end of channel 22, sheet 3 is folded into a U about packet 2 with wings 23 and 24 projecting crosswise and rearwards from packet 2.

As packet 2 continues along path P1, the top wing 23 is folded through 90° onto packet 2, and in particular onto wall 33, by a respective wrapping tool 26; in the course of which folding operation, wing 23 is polarized by an electrostatic field, generated by generating device 29 fitted to respective tool 26, to adhere, once folded, at least temporarily to packet 2.

Once wing 23 is folded, packet 2 is substantially rolled along folding surface 32 to fold the bottom wing 24 of sheet 3 of wrapping material through 90° onto wall 33 of packet 2 and partly onto the previously folded wing 23 to form tubular wrapping 10. Packet 2 is rolled along surface 32 by rotating respective head 8 about respective axis 18; which rotation is effected by said known cam control device (not shown) swinging respective arm 16 about respective axis 17, and provides for moving packet 2 from a substantially tangential to a substantially radial position with respect to axis 14.

As shown in FIG. 7, once folded, wings 23 and 24 of sheet 3 of wrapping material have respective superimposed portions 70.

On leaving surface 32, wall 33, on which wings 23 and 24 have been overlapped, is engaged substantially seamlessly by sealing surface 66 of a respective sealing head 36 carried on wheel 13 and associated with respective conveyor head 8. That is, on coming into contact with respective packet 2, sealing surface 66 is so located as to form a substantially seamless extension of surface 32, and contact between superimposed portions 70 and sealing surface 66 is therefore established by sealing surface 66 gradually facing superimposed portions 70 as superimposed portions 70 are released from folding surface 32, thus preventing sheet 3, and in particular the newly folded wing 24, from springing back to its original configuration.

Superimposed portions 70 remain in contact with sealing surface 66 along a portion of path P1 extending more than 90° about axis 14, from input station S5 to output station S6; and control device 35 controls the known electric generator (not shown) and cooling device 37 so that the temperature of sealing surface 66 equals a lead-in value T1 (actually equal to about 80° C.) upon sealing surface 66 first contacting sheet 3 of wrapping material, and is later increased to a working value T2 (actually equal to about 130° C.) to seal superimposed portions 70.

Each sealing head 36 is therefore fed cyclically and continuously along an endless sealing path extending about axis 14 and through input station S5, where sealing head 36 engages a respective packet 2 to establish contact between respective sealing surface 66 and superimposed portions 70, and through output station S6, where sealing head 36 releases packet 2 to break off contact. Control device 35 provides for increasing the temperature of each sealing surface 66 from value Ti to value T2 as respective head 36 travels from input station S5 to output station S6, and for restoring the temperature of each sealing surface 66 to value T1 as respective sealing head 36 travels from output station S6 to input station S5.

At transfer station S3, packet 2 is restored to a substantially tangential position with respect to axis 14 by rotating respective head 8 about respective axis 18 to transfer packet 2 to conveyor 12. At station S3, packet 2 is engaged simultaneously by conveyor head 8 and by belt 47 of transfer unit 46, which assists in guiding packet 2 into channel 49.

On entering channel 49, packet 2 is engaged by belt 38 and respective projections 39 and is released by conveyor head 8, the two pads 15 of which are moved into an open position in which pads 15 are separated by such a distance as not to interfere with packet 2 or respective tubular wrapping 10.

Since packets 2 are fed by conveyor 9 along path P1 at speed V1 and with spacing St1, and are fed by conveyor 12 along path P2 at speed V2 and with spacing St2, which are respectively slower and smaller than speed V1 and spacing St1, packets 2 undergo a change in speed at station S3, and in particular are slowed down during transfer from head 8 of conveyor 9 to conveyor 12.

The continuous movement of belt 38 feeds packet 2 along path P2 and in particular through channel 49 to straight portion P5, along which each open end 11 of tubular wrapping 10 is engaged by respective fixed helical folding element 45 of folding device 44 and is folded onto respective base 4 of packet 2 to superimpose portions 71 of end 11 as shown in FIG. 5.

At the end of straight portion P5, the two bases 4 of packet 2, onto which ends 11 of tubular wrapping 10 have been folded, are engaged simultaneously by respective sealing heads 53 in a respective pair of heads 53 on wheel 41 to stabilize, by sealing, the superimposed portions 71 of each end 11.

Contact between each sealing surface 59 and respective superimposed portions 71 is established by sealing surface 59 gradually facing superimposed portions 71 as superimposed portions 71 are released by respective folding element 45. For which purpose, each sealing surface 59 is brought gradually into a position facing respective superimposed portions 71 by oscillating respective sealing head 53 with respect to wheel 41 about axis 55 and at the same time about axis 56, which oscillates about axis 55 together with sealing head 53 while remaining perpendicular to axis 55.

Each sealing surface 59 remains in contact with respective superimposed portions 71 along a portion of path P2 extending more than 90° about axis 40, from input station S7 to output station S8; and control device 52 controls the known electric generator (not shown) and cooling device 54 so that the temperature of sealing surface 59 equals a lead-in value T1 (actually equal to about 80° C.) upon sealing surface 59 first contacting sheet 3 of wrapping material, and is later increased to a working value T2 (actually equal to about 130° C.) to seal the superimposed portions of respective end 11.

Each sealing head 53 is therefore fed cyclically and continuously along an endless sealing path extending about axis 40 and comprising input station S7, where sealing head 53 engages a respective packet 2 to establish contact between respective sealing surface 59 and said superimposed portions, and output station S8, where sealing head 53 releases packet 2 to break off contact. Control device 52 provides for increasing the temperature of each sealing surface 59 from value T1 to value T2 as respective head 53 travels from input station S7 to output station SB, and for restoring the temperature of each sealing surface 59 to value T1 as respective sealing head 53 travels from output station S8 to input station S7.

Path P2 terminates at transfer station S4 where the overwrapped packet 2 is transferred in known manner to said known output section (not shown), which feeds packet 2 along a circular drying path P3 extending about an axis 72 parallel to axis 40, and then to said known output (not shown) of machine 1.

On cellophaning machine 1, sealing surfaces 59 and 66 are therefore brought into contact with sheet 3 of wrapping material at a relatively low temperature (lead-in temperature T1) to prevent any creasing and/or undulation of sheet 3.

Heating and subsequent cooling of sealing surfaces 59 and 66 during operation of cellophaning machine 1 are made possible by the very low thermal inertia of plates 65 and 58.

What is claimed is:

1. A method of wrapping a product in a sheet of heat-seal wrapping material, the method comprising the steps of folding said sheet (3) of wrapping material about said product (2) and superimposing at least two portions (70;71) of the sheet (3) of wrapping material one on top of the other against a wall (33;4) of said product (2); establishing contact between the superimposed portions (70;71) and a sealing surface (66;59) of a sealing head (36;53); maintaining the sealing surface (66;59) in contact with said superimposed portions (70;71) for a given time interval; and cutting off contact between the sealing surface (66;59) and said superimposed portions (70;71); wherein the temperature of the sealing surface (66;59) is set to a lead-in first value (T1) as the sealing surface (66;59) first contacts said superimposed portions (70;71), and is increased to a working second value (T2) during said given time interval.

2. A method as claimed in claim 1, wherein the temperature of the sealing surface (66;59) is restored to said first value (T1) upon said contact being cut off.

3. A method as claimed in claim 1, wherein said heat-seal material is polypropylene; said first value (T1) being maintained at around 80° C.; and said second value (T2) being maintained at around 130° C.

4. A method as claimed in claim 1, wherein said sealing head (36;53) is fed cyclically and continuously along an endless sealing path comprising an input station (S5;S7) where the sealing head (36;53) engages said product (2) to establish said contact between said sealing surface (66;59) and said superimposed portions (70;71), and an output station (S6;S8) where the sealing head (36;53) releases said product (2) to cut off said contact.

5. A method as claimed in claim 4, wherein the temperature of said sealing surface (66;59) is increased from said first value (T1) to said second value (T2) as said sealing head (36;53) is fed from said input station (S5;S7) to said output station (S6;S8), and is restored to said first value (T1) as said sealing head (36;53) is fed from said output station (S6;S8) to said input station (S5;S7).

6. A method as claimed in claim 1, wherein said sheet (3) of wrapping material is folded by means of a folding device (30;44) which gradually releases the sheet (3) of wrapping material upon completion of the folding operation; said contact being established by the sealing surface (66;59) gradually facing the superimposed portions (70;71) as the superimposed portions (70;71) are released by the folding device (30;44).

7. A method as claimed in claim 6, wherein said folding device (30; 44) is located in a fixed position relative to a wrapping path (P1; P2) of said product (2); said product being fed along said wrapping path (P1; P2) substantially tangent to the folding device (30; 44).

8. A method as claimed in claim 7, wherein said sealing head (53) is fed along a portion of said wrapping path (P2) in time with said product (2); said sealing surface (59) being brought gradually into a position facing said superimposed portions (71) by means of a first oscillation of the sealing head (53) about a first axis (55) parallel to said wrapping path (P2), and a simultaneous second oscillation of the sealing head (53) about a second axis (56), which oscillates about the first axis (55) together with the sealing head (53) while remaining perpendicular to the first axis (55); and said first axis (55) being fed along said portion of the wrapping path (P2) in time with said sealing head (53).

9. A method as claimed in claim 8, wherein said first oscillation moves said sealing head (53) in a direction perpendicular to the wrapping path (P2).

10. A method of wrapping a product in a sheet of heat-seal wrapping material, the method comprising the steps of folding said sheet of wrapping material about said product and superimposing at least two portions of the sheet of wrapping material one on top of the other against a wall of said product; establishing contact between the superimposed portions and a sealing surface of a sealing head; maintaining the sealing surface in contact with said superimposed portions for a given time interval; and cutting off contact between the sealing surface and said superimposed portions; wherein the temperature of the sealing surface is set to a load-in first value as the sealing surface first contacts said superimposed portions, and is increased to a working second value during said given time interval; said sealing surface being defined by a pad made of thermally insulating material and a plate which is fitted to said pad; electric current being circulated along said plate; the method further comprising the steps of determining the temperature of said plate by a temperature sensor and regulating said electric current in the plate according to the temperature of the plate.

11. A method as claimed in claim 10, wherein said electric current is pulsated by a generator.

12. A method of wrapping a product in a sheet of heat-seal wrapping material, the method comprising the steps of folding said sheet of wrapping material about said product and superimposing at least two portions of the sheet of wrapping material one on top of the other against a wall of said product; establishing contact between the superimposed portions and a sealing surface of a sealing head; maintaining the sealing surface in contact with said superimposed portions for a given time interval; and cutting off contact between the sealing surface and said superimposed portions; wherein the temperature of the sealing surface is set to a lead-in first value as the sealing surface first contacts said superimposed portions; and is increased to a working second value during said given time interval; said sealing surface being defined by a pad made of thermally insulating material and a plate which is fitted to said pad; electric current being circulated along said plate; the method further comprising the steps of determining the temperature of said plate by measuring electrical resistance of said plate and regulating intensity of said electric current in the plate according to the temperature of the plate.

* * * * *